US007472803B2

(12) United States Patent
Kalra et al.

(10) Patent No.: US 7,472,803 B2
(45) Date of Patent: Jan. 6, 2009

(54) SYSTEMS AND METHODS FOR DISPENSING OBJECTS

(75) Inventors: Krishan L. Kalra, Danville, CA (US); Thomas Maxwell, Danville, CA (US); Qi Cao, San Leandro, CA (US); Michael Huang, San Ramon, CA (US); Shahin Iqbal, Danville, CA (US)

(73) Assignee: BioGenex Laboratories, Inc., San Ramon, CA (US)

( * ) Notice: Subject to any disclaimer, the term of this patent is extended or adjusted under 35 U.S.C. 154(b) by 659 days.

(21) Appl. No.: 11/067,657

(22) Filed: Feb. 25, 2005

(65) Prior Publication Data

US 2006/0191952 A1 Aug. 31, 2006

(51) Int. Cl.
*B65G 59/06* (2006.01)

(52) U.S. Cl. ..... 221/257; 221/256; 221/263

(58) Field of Classification Search ..... 221/256, 221/257, 263

See application file for complete search history.

(56) References Cited

U.S. PATENT DOCUMENTS

| | | | | | |
|---|---|---|---|---|---|
| 309,715 | A | | 12/1884 | Harper | |
| 324,717 | A | * | 8/1885 | Meyers | 221/131 |
| 503,139 | A | * | 8/1893 | Hook | 221/257 |
| 1,434,061 | A | | 10/1922 | Lewis | |
| 1,715,169 | A | * | 5/1929 | McKee | 222/541.6 |
| 2,291,187 | A | * | 7/1942 | Johnson | 221/256 |
| 2,635,026 | A | | 4/1953 | Kreul | |
| 2,707,066 | A | | 4/1955 | Stegeman | |
| 3,480,504 | A | | 11/1969 | Good et al. | |
| 3,833,449 | A | | 9/1974 | Johnson | |
| 4,171,241 | A | | 10/1979 | Henderson et al. | |
| 4,305,526 | A | * | 12/1981 | Pfleger | 221/256 |
| 4,783,064 | A | | 11/1988 | Hayashi et al. | |
| 5,193,717 | A | * | 3/1993 | Rink et al. | 221/263 |
| 5,975,349 | A | | 11/1999 | Menes et al. | |
| 6,135,314 | A | | 10/2000 | Menes et al. | |

FOREIGN PATENT DOCUMENTS

| | | | |
|---|---|---|---|
| JP | 59232869 | A | 12/1984 |

* cited by examiner

*Primary Examiner*—Gene Crawford
*Assistant Examiner*—Timothy R Waggoner
(74) *Attorney, Agent, or Firm*—Koestner Bertani LLP

(57) ABSTRACT

An automated dispensing assembly includes a base, and a shuttle mounted in the base and movable under automated control between a loading position and a dispensing position. The shuttle includes a cavity configured to carry an object, such as cover. The depth of the cavity in the shuttle is approximately the same (or less) as the thickness of one of the objects. A storage module is mounted proximate the shuttle. The storage module is configured to store a plurality of objects and includes an opening exposing the next object to be dispensed. The cavity is positioned adjacent the opening in the storage module in the loading position and an edge of the cavity separates the object to be dispensed from the other objects in the storage module as the shuttle moves to the dispensing position.

15 Claims, 9 Drawing Sheets

SYSTEMS AND METHODS FOR DISPENSING OBJECTS

BACKGROUND

Diagnostic laboratories have long used archaic, manual, and cumbersome techniques that often lead to poorly reproducible and inaccurate results. Even today, most molecular and cell-based diagnostic systems use outdated and non-integrated technologies unable to cost-effectively perform massively parallel-scale analyses. System capabilities are further stressed by the genomics revolution that has accelerated demand for potential markers for use in target validation in drug discovery and development. Consequently, additional automation and parallelism are sought to enable efficient specimen handling, processing and analysis.

With the emphasis on lowering costs throughout the health-care industry, efforts are continuously being made to reduce the amount of labor involved, and the associated cost. The primary cost component of preparing and staining a specimen on a slide is labor. Accordingly, many efforts have been devoted to reduce the labor cost component of preparing a slide.

Microscope slide covers are typically thin, fragile, and have relatively accurately plane polished surfaces so that when stacked together they tend to adhere to one another and are difficult to separate. Separation can only reliably be accomplished by sliding one over its immediate neighbor, but this in practice is not easy to accomplish because groups of the slips tend to slide as packs from an end of a stack of such slips and the extraction of a single slip from such a pack requires care and dexterity. Where large numbers of covers have to be routinely applied to microscope slides, this operation can represent a significant proportion of the total workload of the technicians.

SUMMARY

In accordance with an embodiment, an automated dispensing assembly includes a base, and a shuttle mounted in the base and movable under automated control between a loading position and a dispensing position. The shuttle includes a cavity configured to carry an object, such as cover. The depth of the cavity in the shuttle is approximately the same as the thickness of one of the objects but less than two objects. A storage module is mounted proximate the shuttle. The storage module is configured to store a plurality of objects and includes an opening exposing the next object to be dispensed. The cavity is positioned adjacent the opening in the storage module in the loading position and an edge of the cavity separates the object to be dispensed from the other objects in the storage module as the shuttle moves to the dispensing position.

BRIEF DESCRIPTION OF THE DRAWINGS

Embodiments of the invention relating to both structure and method of operation, may best be understood by referring to the following description and accompanying drawings whereby.

DETAILED DESCRIPTION

Figure 1:
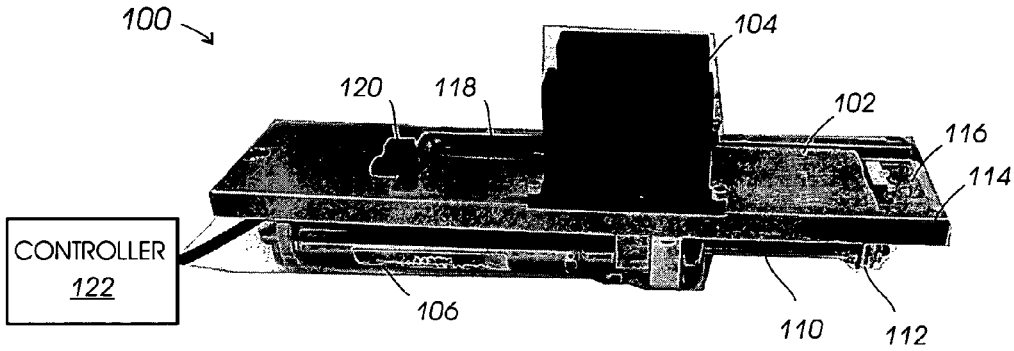
FIG. 1 is a perspective view of an embodiment of a cover dispensing apparatus in accordance with the teachings of this disclosure.
Figure 2A:
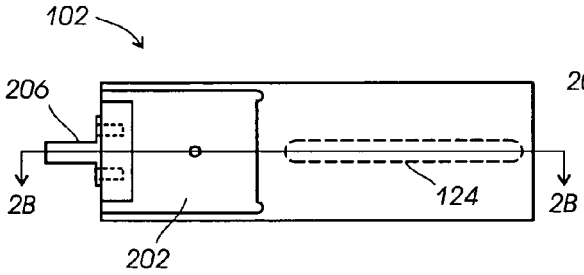
FIGS. 2A-2B show top and side views of a cover shuttle that can be used with the cover dispensing assembly of FIG. 1.
Figure 2B:
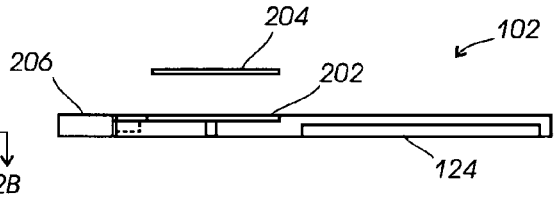

Referring to FIG. 1, an embodiment of a cover dispensing apparatus 100 is shown for automatically dispensing covers one at a time. Apparatus 100 includes shuttle 102, and cover storage module 104 (also referred to as a magazine). An actuator 106 is coupled to move shuttle 102 bi-directionally adjacent storage module 104. Shuttle 102 includes a cavity 202 (shown in top and side views of shuttle 102 in FIGS. 2A and 2B) with a depth that is approximately the same or slightly less than the thickness of one cover 204. Gravitational force causes the lowest cover in storage module 104 to occupy cavity 202 when shuttle 102 is in a loading position located under the storage module 104. The height of the remaining surface area of shuttle 102 is substantially smooth and flat, and configured to just clear the lower edge of storage module 104 during operation.

Figure 3:
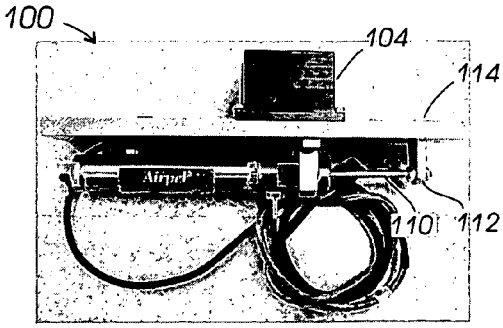
FIG. 3 is a side view of the cover dispensing assembly of FIG. 1 showing an actuating mechanism in a retracted position.
Figure 4:
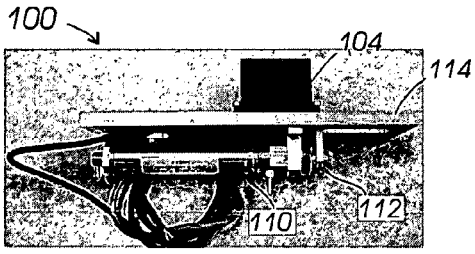
FIG. 4 is a side view of the cover dispensing assembly of FIG. 1 showing an actuating mechanism in an extended position.

Actuator 106 includes an extendable and retractable arm 110 coupled to shuttle 102 via link 112. In the embodiment shown in FIGS. 1 and 3, shuttle 102 is in the loading position when arm 110 is extended. As shown in FIG. 4, arm 110 retracts to move shuttle 102 to a dispensing position that exposes the cover in the cavity 202 for access by an automated cover handling system (not shown).

Figure 5A:
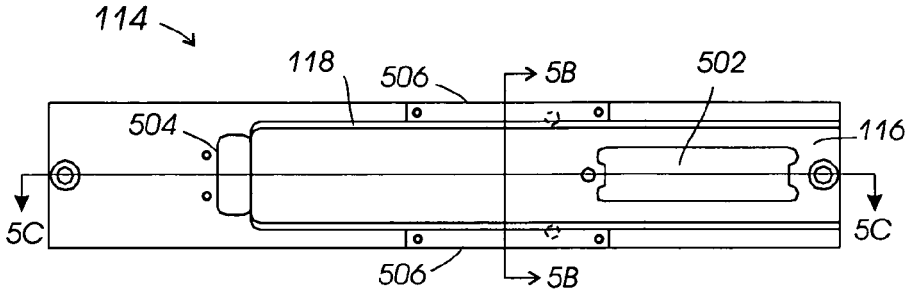
FIGS. 5A-5C show top and side views of a shuttle base that can be used with the cover dispensing assembly of FIG. 1.
Figure 5B:
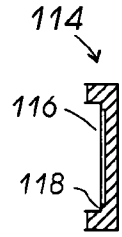

Shuttle 102, storage module 104, and actuator 106 can be coupled to base 114. In the embodiment shown, storage module 104 is fastened to base 106, and shuttle 102 is positioned to move relative to storage module 104 by moving back and forth in channel 116 in base 114. In still further embodiments, both storage module 104 and shuttle 102 can be configured to move relative to one another. Channel 116 can be configured with an elongated opening 502 (FIG. 5A) to allow actuator 106 to be mounted on one side of base 114 and link 112 to be positioned in opening 502 to couple to shuttle 102 and/or storage module 104 on another side of base 114.

Base 114 and/or channel 116 can include means for reducing friction in the movement of shuttle 102 (and/or storage module 104). For example, in some embodiments, base 114 and/or shuttle 102 can be fabricated with oil-impregnated material to reduce the coefficient of friction between moving surfaces. Channel 116 and/or shuttle can also include one or more rails 118 to reduce the amount of surface area in contact between channel 116 and shuttle 102. In some embodiments, rails 118 are configured as slightly raised fillets along at least a portion of the junction of the sides and bottom of channel 116. In other embodiments, one or more rails 118 can be configured in the central portion of channel 116. In such embodiments, one or more corresponding slots (not shown) can be included on the bottom of shuttle 102 to engage the rails 118. In further embodiments, ball-bearings or other suitable friction-reducing components can be used instead of or in addition to rails 118 to facilitate movement between storage module 104, shuttle 102, base 114, and channel 116.

One or more alignment guides 124 can also be included on shuttle 102, channel 116, storage module 104, or other suitable component in apparatus 100 to help maintain cavity 202 in alignment with respect to channel 116 and/or storage module 104. For example, shuttle 102 can include alignment guide 124 configured as a slot that engages guide member 702 (FIG. 7) in base 114. Guide member 702 can be a threaded fastener that protrudes through an opening in base 114 or other suitable guide member.

Apparatus 100 can include one or more sensors 120 that are adapted to indicate to automated controller 122 whether a cover is available to be retrieved from cavity 202 by a cover handling system. For example, sensor 120 can detect and generate signals indicating the position of shuttle 102, link 112, and/or arm 110 of actuator 106. In the embodiment shown, sensor 120 is an optical sensor positioned at one of channel 116. One component of optical sensor emits a light that is detected by another sensor component a short distance away. Tab 206 can be positioned on one end of shuttle 102 to move into the space between sensor components and prevent the light from being detected when shuttle 102 moves to the dispensing position. Interruption of the light causes a change in the signal sent to controller 122 by optical sensor 120.

Controller 122 includes a computer processor with continuously-executing logic instructions that determine when the signal from optical sensor 120 changes to a state that indicates when a cover 204 is available in cavity 202. Controller 122 can then generate signals to operate a cover handling system (not shown) by retrieving cover 204 and place cover 204 over a prepared specimen, such as a biological sample on a microscope slide. Cavity 202 can include an opening 206 to help prevent a vacuum from forming between cover 204 and cavity 202, thereby facilitating removal of cover 204 from cavity 202. Opening 206 can also prevent a vacuum from forming and causing an error condition when a cover handling device attempts to use suction to pick up a cover 204, and cover 204 is not present in cavity 202.

In some embodiments a cover handling system can be equipped to clean, add substance(s), create a boundary, or otherwise prepare cover 204 before retrieving cover 204 and placing cover 204 over a specimen. Additionally, cavity 202 and/or cover 204 can include detectable components to enable the cover handling system to determine the position and/or orientation of the cover 204 in cavity 202. For example, the cover handling system can include sensors that detect a pre-determined pattern of paint or other substance that can be included on the surface of cavity 202 and/or cover 204.

The cover handling system can send one or more signals to controller 122 indicating the processing state of cover 204, including when cover 204 has been removed from cavity 202. Controller 122 can be coupled to send drive signals to actuator 106 to move shuttle 102 (and/or storage module 104) to load another cover 204 in cavity 202, as required.

Actuator 106 can send feedback signals to controller 122 indicating the position of arm 110. Controller 122 can use the position information to determine when to stop sending drive signals to actuator 106. For example, controller 122 can be programmed with, or have access to, information regarding the size, shape, orientation, and/or location of components in apparatus 100. Logic instructions can be included in controller 122 to determine when cavity 202 is positioned so that another cover 204 can be loaded in cavity 202. Sensor 120 will typically also change state when tab 206 is moved from between sensor components. Controller 122 can use the changed state information to determine that shuttle 102 has moved.

Other suitable means for controlling the position of moving components in apparatus 100 can be included, such as mechanical stop(s), and/or sensors on link 112 or other suitable portions of apparatus 100. For example, cavity 202 can include a weight and/or optical sensor that detects when a cover 204 is in cavity 202 and provides a signal to controller 122 indicating such a condition. Signals between components on apparatus 100 can be transmitted and received via wireless and/or wired communication interfaces. Controller 122 can also interface to a central control unit as well as one or more other component controllers that operate other components in an automated processing system.

Figure 5C:
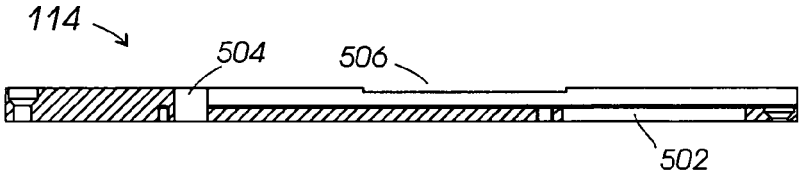

Referring now to FIGS. 6A-6D, FIGS. 6A and 6B show perspective and top views, respectively, of an embodiment of storage module 104. A stack of covers 204 can be loaded in an open side of cavity 602 of storage module 104, and dispensed from an opening 604 on another side of storage module 104 that is positioned adjacent shuttle 102. Flanges 606 or other suitable structure can be included on storage module 104 to enable storage module 104 to be removably attached to base 114. Slots 506, as best shown in respective top and side cross-sectional view of base 114 in FIGS. 5A and 5C, can be included to help insure proper placement of flanges 606 on base 114.

Figure 6A:
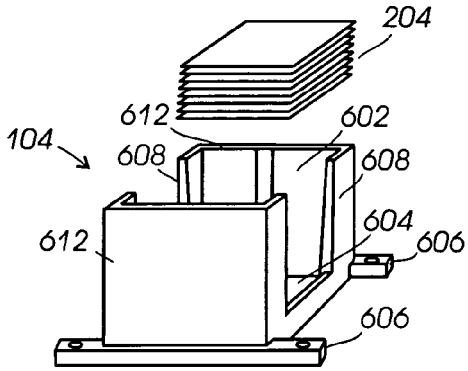
FIGS. 6A-6B show perspective and top views of a cover storage module that can be used with the cover dispensing assembly of FIG. 1.
Figure 6B:
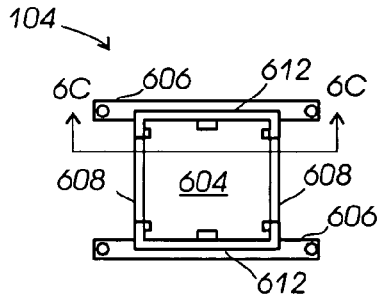

As shown in FIG. 6A, two opposing sides 608 of storage module 104 can include substantial openings to facilitate placement and removal of covers 204 in storage module 104. The edge portion of sides 608 adjacent shuttle 102 are configured to be a distance less than the thickness of cover 204 from the portions of shuttle 102 surrounding cavity 202 to prevent a cover 204 from slipping or being caught between storage module 104 and shuttle 102 as shuttle 102 moves from the dispensing position to the loading position.

Figure 6C:
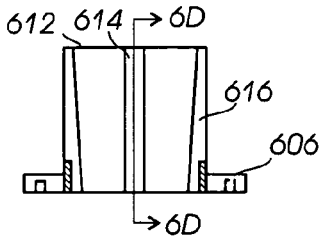
FIGS. 6C-6D show side views of a cover shuttle that can be used with the cover dispensing assembly of FIG. 1.
Figure 6D:
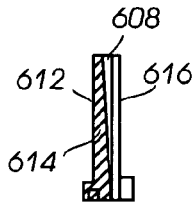

In the embodiment shown, storage module 104 includes two other opposing sidewalls 612, which, along with sidewalls 608, form a square, rectangular, or other suitably shaped inner cavity 602 where covers 204 can be placed. FIG. 6C is a cut-away view of sidewall 612 that faces cavity 602 and FIG. 6D is a further cut-away view of sidewall 612 to show tapered guide members 614, 616 on walls 612, 608, respectively. Tapered guide members 614, 616 can be included to facilitate placing covers 204 in proper position in cavity 602, and can extend along substantially all or a portion of the depth of cavity 602, gradually increasing in width to the bottom of cavity 602. One or more guide members 614, 616 can be included on one or more of walls 608, 612. Alternatively, walls 614, 616 can be suitably tapered along their entire width across cavity 602.

Figure 7:
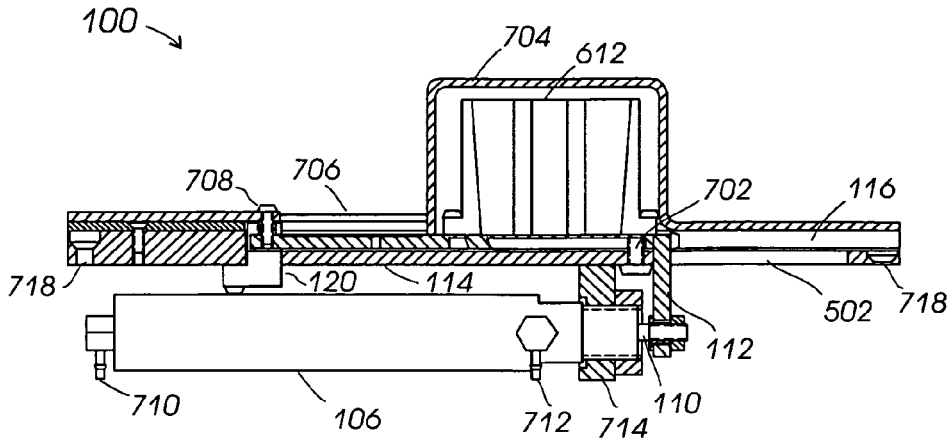
FIG. 7 shows a cut-away side view of the cover dispensing assembly of FIG. 1.

FIG. 7 shows a cut-away side view of apparatus 100 that includes cover 704, which can be positioned over storage module 104 to prevent contaminants from being introduced to a stack of covers 204. Cover 704 can extend over other portions of apparatus 100 and attached to base 114 with one or more suitable fasteners 708. An opening 706 is configured in cover 704 over cavity 202 to allow access to dispensed covers 204.

FIG. 7 also shows that actuator 106 can include input port 710 and output port 712 to accommodate the flow of fluid to operate actuator 106. One or more attachment member 714, such as a lug or other suitable structure, can be fastened to base 114 to support/couple actuator 106 to apparatus 100. Base 114 can further include one or more openings 718 to allow apparatus to be mounted on another device, such as an automated sample processing system.

Note that multiple cover storage modules 104 configured to accommodate different sizes and shapes of covers 204 can be provided, along with corresponding shuttles 102 with appropriately configured cavities 202. Note further that covers 204 can be fed through storage modules 104 using gravitational and/or applied force. For example, storage module 104 can be spring loaded to apply suitable pressure to the top of a stack of covers 204.

Figure 8A:
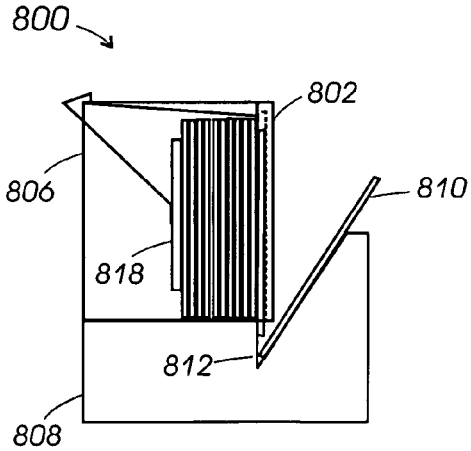
FIGS. 8A-8B show respective front and top views of another embodiment of a cover dispensing apparatus.
Figure 8B:
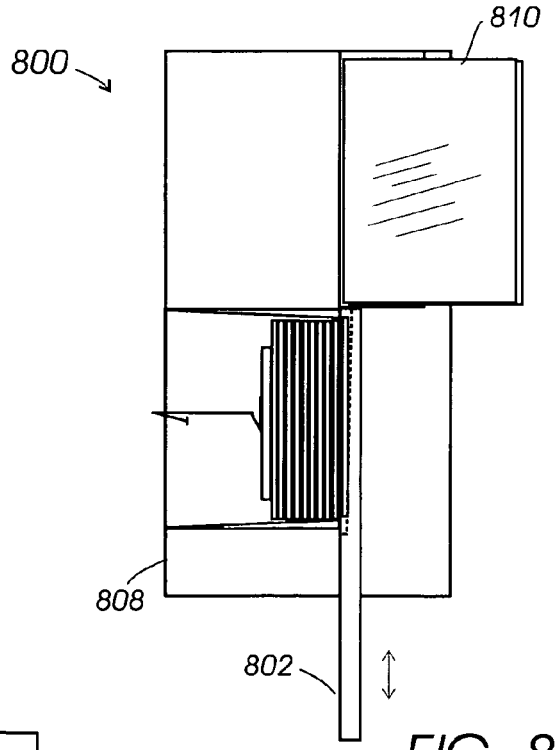
Figure 8C:
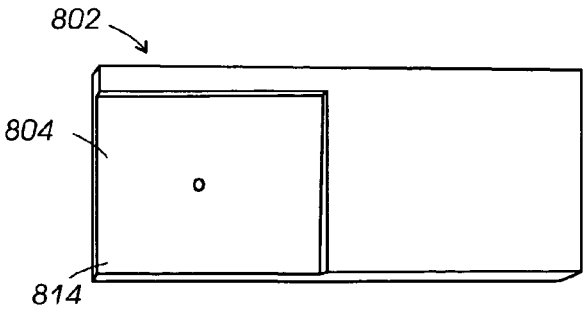
FIG. 8C shows a front view of the shuttle of FIGS. 8A-8B.

Storage module 104 and shuttle 102 can be oriented in any suitable direction. In the embodiments shown in FIGS. 1 and 7, storage module 102 is positioned above shuttle 102, and covers 204 lay flat in cavity 202. It is anticipated, however, that shuttle 102 and storage module 806 can be oriented at an angle, depending on the type of device to be used to grip dispensed covers 810. For example, FIGS. 8A-8B show respective front and top views of an embodiment of cover dispensing apparatus 800 that includes shuttle 802 configured with cavity 804 that is substantially vertical. An actuator (not shown) can move shuttle 802 across an opening in storage module 806 to remove a single cover 810 from one end of a stack of covers 810, similar to apparatus 100 described herein. Base 808, or other suitable portion of apparatus or the device in which apparatus 100 is installed, can be configured with a slot 812 to receive cover 810 from an open edge 814 of cavity 804 as shuttle moves past storage module 806.

In some embodiments, slot 812 can be angled to place cover 810 in a more accessible location/orientation. The sidewalls of cavity 804 can be tapered and cavity 804 can include an opening to facilitate releasing cover 810. Shuttle 802 can return to the loading position once cover 810 is dispensed into slot 812. Note that slot 812 can be configured so that a portion of cover 810 can be grasped from two sides and/or along two edges. Such a configuration allows cover 810 to be grasped by a mechanical gripper as well as other devices such as a suction cup or electrostatic device. Note also that storage module 806 includes means for applying force, shown as a spring-loaded cap 818, to move the vertical stack of covers 810 toward shuttle 802 without binding movement of shuttle 802.

In other embodiments, components in apparatus 100 and 800 can be arranged so that storage modules 104, 806 move relative to stationary shuttles 102, 802. Further, any suitable type and number of actuators 106 can be used to move component(s) in apparatus 100, 800, such as actuators that are driven pneumatically, hydraulically, electromagnetically, piezoelectrically, mechanically, and/or electro-mechanically, among others.

Shuttle 102 can also be configured with two or more cavities 202, 804. Further, shuttle 102, 802 can be implemented using alternative structures, such as a conveyer belt with a series of cavities 202, 804 that move past storage module 104, 806 and dispense individual or multiple covers 204, 810. For example, the length of slot 812 can be dimensioned to accommodate a series of dispensed covers 810, one after another, that are available for use by one or more automated sample processing systems. The movement of shuttle 802 can move the series of covers 810 along the slot as each cover 810 is dispensed.

Figure 9A:
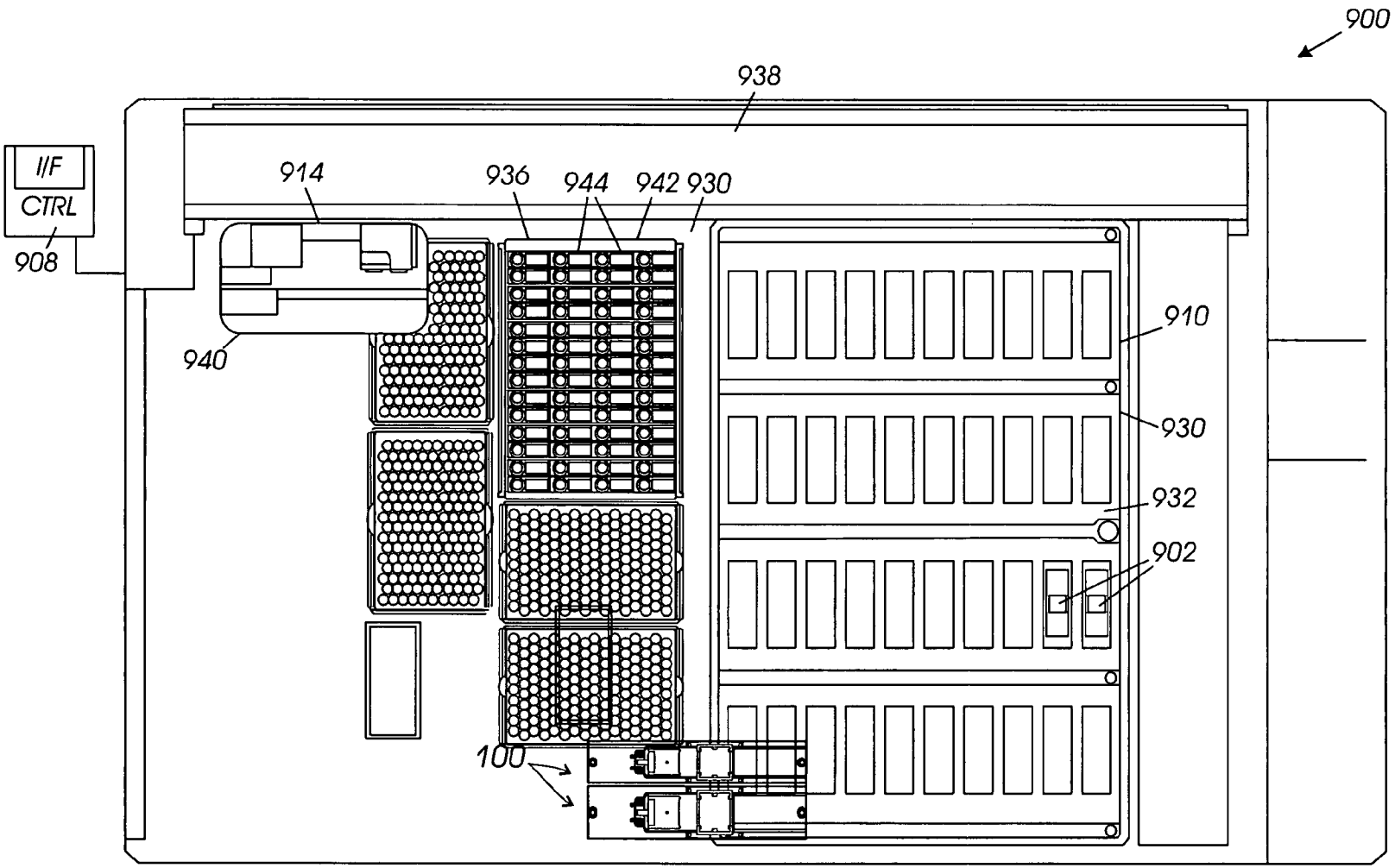
FIGS. 9A-9C show multiple views of a sample processing system that can utilize the cover dispensing apparatus of FIGS. 1 and 8A-8B is adapted to concurrently and individually control processing of a plurality of samples is shown.
Figure 9B:
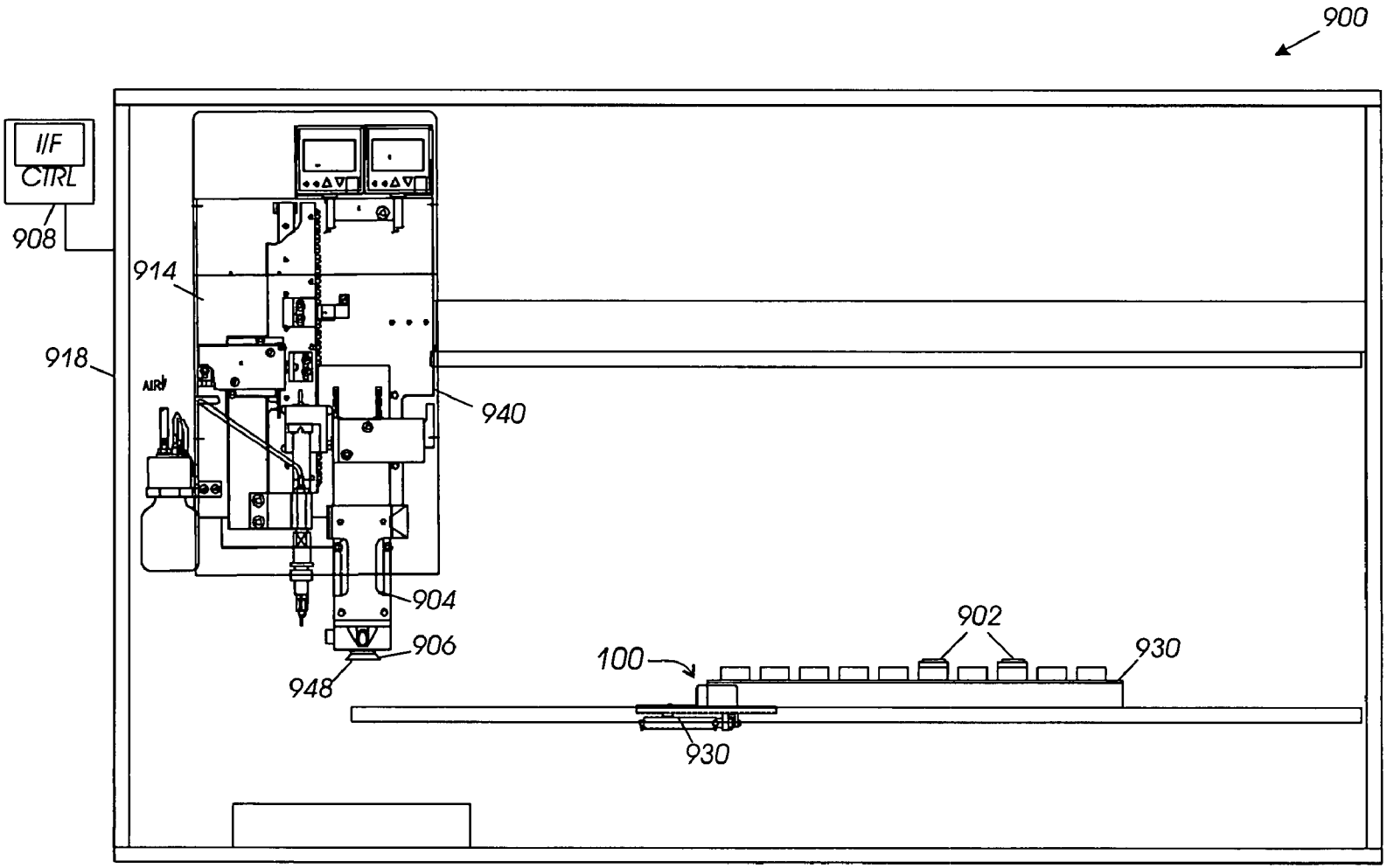
Figure 9C:
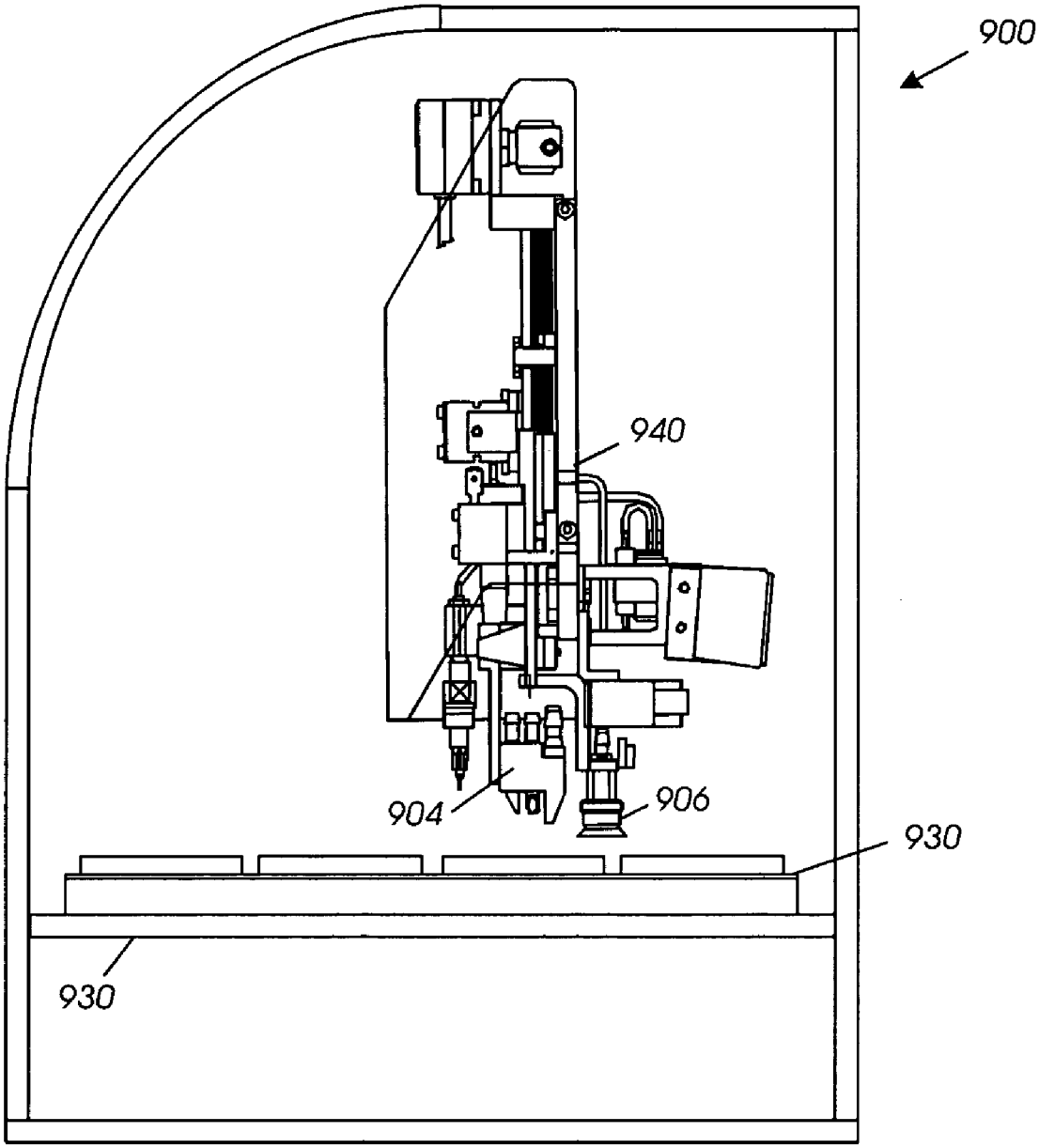

Referring to FIGS. 9A-9C, multiple views of a sample processing system 900 that is adapted to utilize cover dispensing apparatus 100, 800 and concurrently and individually control processing of a plurality of samples is shown. The illustrative sample processing system 900 is a self-contained, automated system with cover placement and removal capabilities, precision aspirating and dispensing of reagents, and individual temperature control for specimens 902.

In some embodiments, sample processing system 900 includes a platform 930 and rack 942 that can be held by the platform 930 or coupled to the platform 930 and adapted to hold multiple reagent containers 944. Rack 942 can also be configured with one or more individually controllable heating elements to maintain the reagents at different selected temperatures. Sample processing system 900 can also be configured to independently maintain a plurality of specimens 902 at different environmental conditions, such as different temperature, light, and/or humidity levels.

In some embodiments, robotic device 940 is mounted on a movable arm 914 that can be positioned in one, two, and/or three dimensions relative to platform 930. Robotic device 940 can be configured to accept different types of attachments to perform various different operations and functions, such as gripping and releasing covers; positioning and removing a cover from a specimen; loading and dispensing substances; loading and dispensing sealant to create a barrier around a specimen; mixing specimen contents; washing a specimen 902; and drying a specimen 902, among others.

In some embodiments, robotic device 940 includes a cover handling device 906 adapted to dispense covers of one or more sizes on reservoirs to form the specimens 902. Cover dispensing apparatus 100, 800 can be included in system 900 to enable covers to be automatically dispensed one at a time. Cover handling device 906 can be adapted to retrieve loose covers from a cavity 202 of cover dispensing apparatus 100 and/or other suitable location in or around cover dispensing apparatus 100, 800 or sample processing system 900. Robotic head 940 can further include a metering pump, a vacuum pump, cable train and printed circuit board containing components and devices for controlling robotic head 940.

Storage module 104 can be refillable and constructed from aluminum, stainless steel, plastic, or other suitable material.

Sample processing system 900 can be configured with one or more sensors to detect the position and orientation of the covers on the specimens 902 or other locations in sample processing system 900. In some embodiments, one or more of the sensors can be located on or in the movable arm 914 and/or robotic device 940. The sensors can also be located in a stationary position, in addition to, or instead of, being co-located with the movable arm 914 and/or robotic device 940.

In some embodiments, the sample processing system 900 can include a substance dispensing device 904 that is adapted to dispense one or more substances, such as a reagent, on specimens 902. Cover handling device 906 can operate in combination with the substance dispensing device 904 to automate placement and removal of the covers over specimens at the appropriate time(s) during processing.

Controller 908 can be included in the sample processing system 900 to execute logic instructions that control operations and functionality of components in the sample processing system 900, such as substance dispensing device 904, cover dispensing apparatus 100, and cover handling device 906. Controller 908 can also be adapted to operate components in sample processing system 900 to control the microenvironment of specimens 902. Programmed logic instructions associated with particular protocols and processes can specify actions to be taken at particular times such as placing a cover on a specimen 902, removing a cover from specimen 902, heating or cooling a reagent, dispensing a specified reagent to specimen 902; heating or cooling specimen 902, and/or washing specimen 902 and/or cover, among others. For example, a particular process can be associated with a particular specimen 902 or group of specimens 902 via a user interface. The process can specify dispensing a first reagent to a reservoir containing a sample, placing and sealing a cover on specimen 902, removing the cover from specimen 902, washing the reagent from specimen 902, drying specimen 902, dispensing a second selected reagent to specimen 902, again covering specimen 902, and selectively repeating the various actions.

Referring to FIGS. 10A-10D, examples of embodiments of various devices that can be used as the cover handling device 906 of FIGS. 9A-9C are shown. An effector 1006 is coupled to a robotic head 1004. One or more dispenser apparatus 100, 800 can dispense covers of one or more different sizes or other characteristics. Robotic head 1004 is adapted to move to the vicinity of dispensing apparatus 100, 800 to allow the effector 1006 to retrieve a cover from the dispenser 100, 800. Effector 1006 can be operated to perform multiple functions including placing and removing covers from a specimen.

Figure 10A:
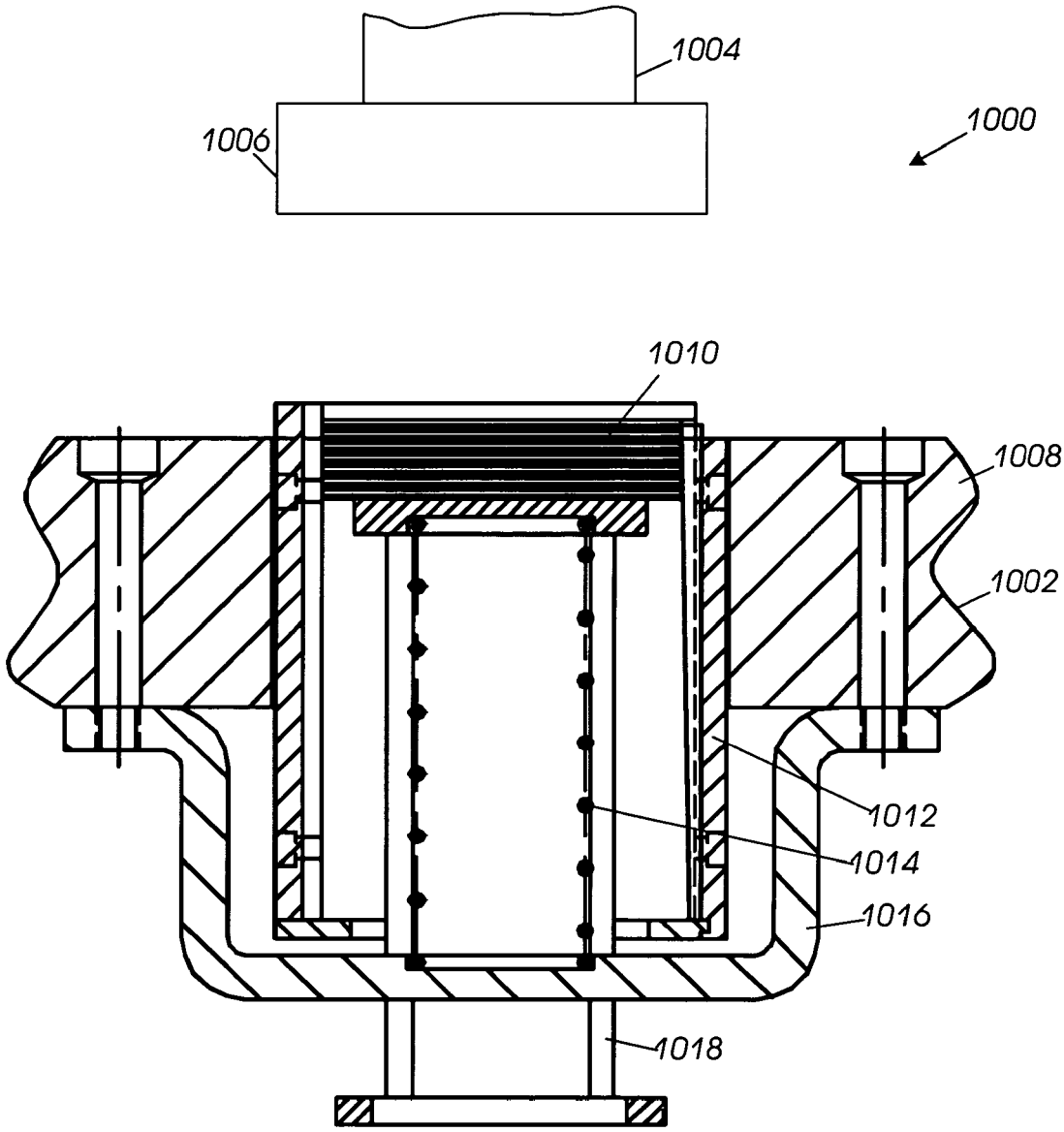
FIGS. 10A-10D show embodiments of various devices that can be used as the cover handling device in the sample processing system of FIG. 9A.
Figure 10B:
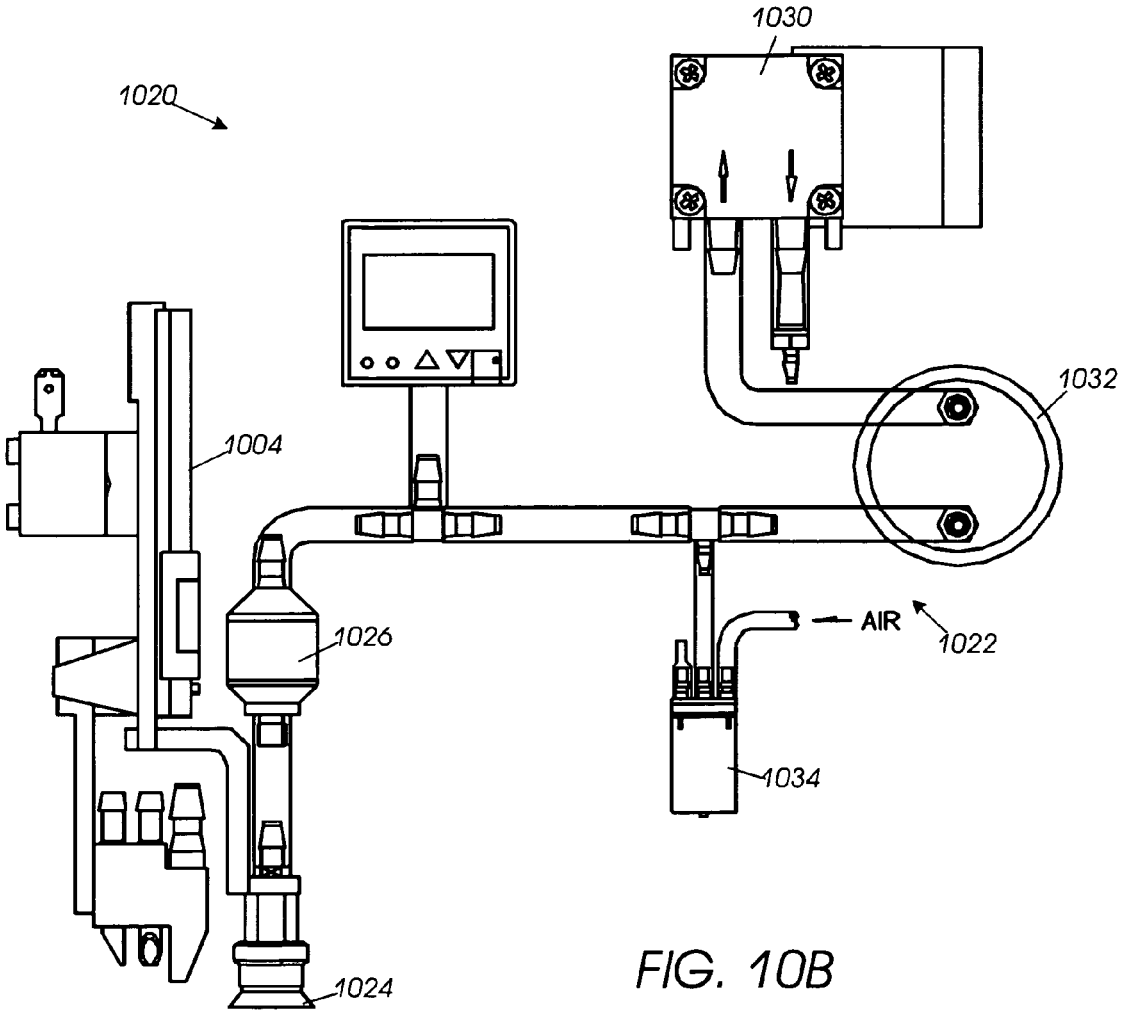

FIG. 10B shows an embodiment of cover handling system 1020 that includes a vacuum system 1022 including a vacuum pad effector 1024 that grips and releases the covers. The vacuum system 1022 can include a water separator 1026, a vacuum sensor 1028, a vacuum pump 1030, a vacuum buffer 1032, and/or an air valve 1034. The vacuum sensor 1028 can be configured to supply signals to controller 908 (FIG. 9A) to control operation of the cover handling system 1020.

When vacuum sensor 1028 indicates increased pressure, logic in controller 908 assumes that a cover is obstructing an opening in effector 1024 through which vacuum pressure is exerted by the vacuum pump 1030. After a cover is placed in position, vacuum pump 1030 is turned off and air valve 1034 opens, enabling positive air pressure to push the cover off vacuum pad effector 1024. The operation prevents the cover from adhering to vacuum pad effector 1024.

Figure 10C:
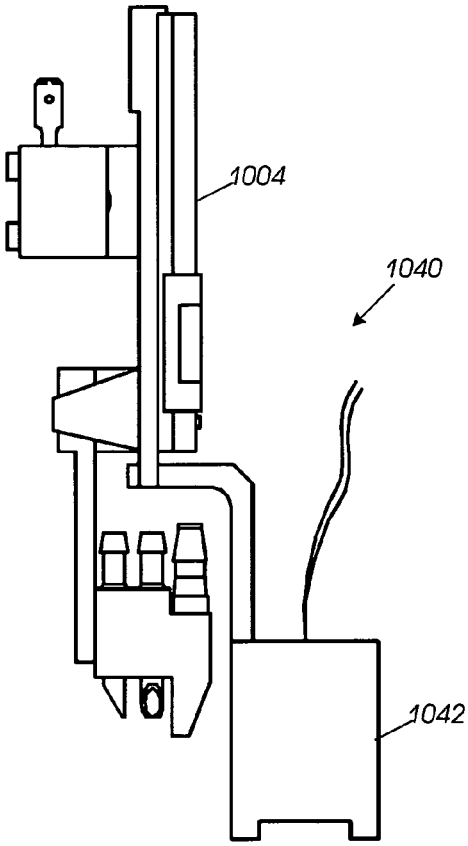

FIG. 10C shows an embodiment with an electromagnetic effector 1040 further comprising an electromagnetic attachment device 1042 that grips and releases the covers 204. In such embodiments, covers 204 can be configured with one or more magnetic portions. For example, covers 204 may be configured with a magnetic paint or coating, chemical coating, a conductive material, foil, or other suitable material. The material can be painted, embossed or otherwise configured to prevent covers 204 from adhering to one another. The electromagnetic attachment device 1042 can be operated to generate positive and negative electrical fields that attract and repel the magnetic material on the covers 204.

Figure 10D:
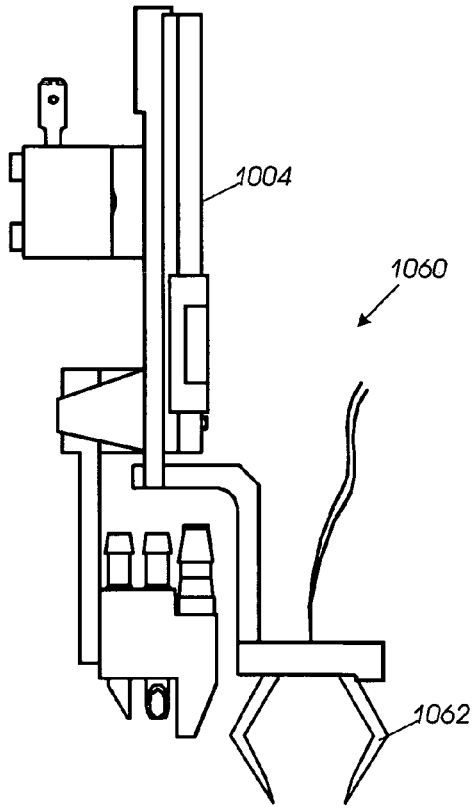

FIG. 10D illustrates an embodiment with an effector 1060 further comprising a mechanical gripper device 1062 that grips and releases covers 204. Gripper device 1062 can include two or more fingers or grippers that move in one or more dimensions. The grippers can be padded, coated with rubber, or other suitable substance to facilitate handling of the covers 204. The position and operation of electromechanical fingers can be controlled by controller 908.

In the various embodiments, controller 908 controls operation of robotic head 1004 and effectors 1006, 1024, 1042, 1062. Logic instructions executed by controller 908 can be adapted to control placement and removal of covers 204 from specimens in a manner that minimizes formation of air bubbles and disturbance to the specimen. For example, robotic head 1004 and effectors 1006, 1024, 1042, 1062 can be operated to place a dispensed cover 204 on a specimen by starting on one edge or corner and slowly lowering the cover 204 to minimize air bubbles. Various processes to remove covers 204 can be used after completion of the reaction, e.g., peeling off the edge of the cover 204 from the specimen, followed by blowing or washing off the specimen and/or cover 204, or disposing of used covers 204 into a waste tray.

In some embodiments, effector 1006, 1024, 1042, 1062 and robotic head 1004 may be configured to move independently of one another. Note that other suitable devices can be utilized, in addition to, or instead of effectors 1006, 1024, 1042, 1062 to handle covers 204.

Note also that other mechanisms can be used to dispense covers 204. For example, one or more belts, pads, or rollers mounted on a spindle or shaft that is driven by a suitable motor, such as a stepper motor, servo motor, or DC motor, can be used to dispense covers 204 one at a time instead of shuttle 102. The belts/rollers/pads can be fabricated from rubber, plastic, glass, or other suitable material. The belts/rollers/pads can include sprockets that engage holes on the edges of covers 204 to move covers 204 one at a time as the spindle rotates. Covers 204 can be dispensed one at a time onto a platform, into a caddy, into a container or other suitable location as the shaft rotates.

In some embodiments, a rack of covers 204 can be inclined and configured to allow one cover 204 at a time to be dispensed from the stack of covers 204. Covers 204 with different thickness and shapes can be included in such stacks.

In other embodiments, needles or probes can be mounted on robotic device 940 that can be manipulated to lift and lower covers 204 via holes in the edges of covers 204. The needles can be inserted in the holes to pick up and carry a cover 204 to a desired specimen. The needles can be moved in one or more dimension by any suitable actuator, motor, or other mechanism.

In still further embodiments, covers 204 can be placed in a round tray (carousel) that can include sockets to retain covers 204. The tray can driven to move in a circular motion by a motor or other suitable mechanism so that one or more covers 204 can be accessed by effectors 1006, 1024, 1042, 1062 at a time.

In other embodiments, covers 204 can be included in an enclosure mounted on robotic device 940. One or more covers 204 at a time can be dispensed from the enclosure onto a specimen. Covers 204 can be ejected from a slot in the enclosure by a suitably shaped piston or other mechanism.

Covers 204 can be configured in a continuous roll of plastic or other suitable material that may be peeled off by an electromechanical gripper or other suitable device. The roll of cover material can be dispensed from robotic device 940 or other suitable location in system 900. Covers 204 may be perforated to facilitate removal from the roll, or a cutting edge or device can be included on the robotic device 940 or other suitable location to cut a desired length of cover material. The dispensing can be controlled by a laser sensor senses the length of one cover 204 at a time, a mechanical ejector that is geared to dispense a measured portion of cover material, or other suitable mechanism.

Controller 908 can be adapted to automatically mount and dismount enclosures containing cover 204, as well as rolls of cover material, on robotic device 940. Controller 908 can further be adapted to sense or count the number of covers remaining or dispensed to determine when the enclosure is empty and needs to be replaced. The replacement enclosures can be provided in a location in system 900 that is accessible by robotic device 940. Empty enclosures can be discarded in a waste bin provided with system 900 or other suitable location. Controller 908 can be configured to issue a re-fill alert message when a predetermined amount and/or all of the covers 204 have been dispensed.

Individual covers 204 can be spaced in a rack or separated by a suitable spacer, such as a thin piece of paper, to help prevent covers 204 from adhering to one another. Covers 204 can include chemical coatings (entirely or partially, e.g. paint lines on the edges) or other separators that allow removal of one cover 204 at a time from a stack with an effector 1006, 1024, 1042, 1062. Stacks of covers 204 can also be provided in a variety of configurations such as a continuous strip of fan-folded covers 204 where the edges of covers 204 are at least partially connected to one another. The connection between the edges can be separated by force from effectors 1006, 1024, 1042, 1062, or other suitable separating/cutting device.

While cover dispensing apparatus 100, 800 can be used to dispense covers 204 in automated sample processing system 900, dispensing apparatus 100, 800 can also be adapted to dispense objects other than cover slips, such as coins, and other substantially flat objects. Virtually any size, shape, and number of objects can be dispensed, one or more at a time, for access by an automated processing machine or even by a human.

While the present disclosure describes various embodiments, these embodiments are to be understood as illustrative and do not limit the claim scope. Many variations, modifications, additions and improvements of the described embodiments are possible. For example, those having ordinary skill in the art will readily implement the steps necessary to provide the structures and methods disclosed herein, and will understand that the process parameters, materials, and dimensions are given by way of example only. The parameters, materials, and dimensions can be varied to achieve the desired structure as well as modifications, which are within the scope of the claims. For example, although particular systems are described that include many novel features, each of the different features may be implemented in a system that either includes or excludes other features while utility is maintained.

In the claims, unless otherwise indicated the article "a" is to refer to "one or more than one".

What is claimed is:

1. An automated dispensing assembly comprising:

a base;

a shuttle mounted in the base and movable under automated control between a loading position and a dispensing position, wherein the shuttle includes a cavity configured to carry an object, the depth of the cavity in the shuttle being approximately the same as the thickness of one of the objects;

a storage module mounted proximate the shuttle, wherein the storage module is configured to store a plurality of objects and includes an opening exposing the next object to be dispensed, further wherein the cavity is positioned adjacent the opening in the storage module in the loading position and an edge of the cavity separates the object to be dispensed from the other objects in the storage module as the shuttle moves to the dispensing position;

an actuator coupled to move the shuttle between the loading position and the dispensing position;

a sensor coupled to detect and generate a signal indicating the position of at least one of the group consisting of: the shuttle and the actuator; and a controller configured to:

control operation of a handling system to remove the object from the cavity;

receive signals from the sensor; and control operation of the actuator by automatically determining whether another object should be dispensed.

2. The assembly according to claim 1 wherein the base is fabricated with oil-impregnated material.

3. The assembly according to claim 1 wherein the base includes a channel, and the shuttle is positioned in the channel.

4. The assembly according to claim 3 further comprising one or more rails between the base and the shuttle, wherein the shuttle moves in the channel along the rail(s).

5. The assembly according to claim 1, further comprising:

an opening through the cavity to facilitate removal of the object from the cavity.

6. The assembly according to claim 1 wherein the sensor is configured to optically detect the presence of the shuttle when the shuttle reaches at least one of the group consisting of: the dispensing position and the loading position.

7. The assembly according to claim 1 further comprising:

detectable components on the assembly or on the object to enable the handling system to determine the orientation of the object in the cavity.

8. The assembly according to claim 1 wherein the objects are fed through the storage module by at least one of the group of: gravity and an applied force.

9. A method of dispensing objects comprising:

sliding a shuttle back and forth adjacent an opening in an object module via an actuator coupled between the shuttle and an automated controller;

receiving an object from the object storage module when the shuttle is in a first position, wherein the object is received in a cavity in the shuttle, the depth of the cavity is approximately the thickness of one object; and exerting force against one edge of the object in the cavity with an edge portion of the cavity to separate the object from remaining objects in the object storage module as the shuttle moves from the first position to a second position while the remaining objects are retained in the object storage module;

controlling operation of an object handling system to remove the object from the cavity; and controlling operation of the actuator by automatically determining whether another object should be dispensed.

10. The method according to claim 9 wherein the shuttle is positioned in a channel in a base, and the channel is configured to reduce friction between the shuttle and the base.

11. The method according to claim 9 further comprising:

automatically detecting the position of the shuttle when the shuttle is in at least one of the group consisting of: the first position and the second position.

12. The method according to claim 9 further comprising:

generating a signal indicating the position of at least one of the group consisting of: the shuttle and the actuator.

13. An apparatus comprising:

a shuttle;

an object storage module including an opening to allow access to one of a plurality of objects;

an actuator configured to:

communicate with an automated controller:

move at least one of the group consisting of: the shuttle and the storage module, bi-directionally with respect to the other;

wherein the shuttle includes:

a cavity configured to receive an object from the storage module, the depth of the cavity being approximately the thickness of one object;

a sensor adapted to indicate to the automated controller whether an object is available to be retrieved by an object handling system; and the automated controller is configured to:

receive signals from the sensor;

control operation of an object handling system to remove the object from the cavity; and control operation of the actuator by automatically determining whether another object should be dispensed.

14. The apparatus according to claim 13 further comprising:

a plurality of object storage modules configured to accommodate different sizes of objects; and a plurality of shuttles corresponding to the plurality of storage modules, wherein the cavities in the shuttles are sized to accommodate the objects in the corresponding storage module.

15. The assembly according to claim 13 further comprising:

a base, wherein the shuttle and the storage module are coupled to the base, the base including means for reducing friction in the movement of at least one of the shuttle and the storage module.

* * * * *